US011124331B2

(12) United States Patent
Dentino

(10) Patent No.: US 11,124,331 B2
(45) Date of Patent: Sep. 21, 2021

(54) LETTER ENVELOPE

(71) Applicant: American Litho, Inc., Carol Stream, IL (US)

(72) Inventor: Sam J. Dentino, Bloomingdale, IL (US)

(73) Assignee: American Litho, Inc., Carol Stream, IL (US)

( * ) Notice: Subject to any disclaimer, the term of this patent is extended or adjusted under 35 U.S.C. 154(b) by 0 days.

(21) Appl. No.: 16/539,795

(22) Filed: Aug. 13, 2019

(65) Prior Publication Data

US 2020/0047950 A1 Feb. 13, 2020

Related U.S. Application Data

(60) Provisional application No. 62/718,316, filed on Aug. 13, 2018.

(51) Int. Cl.
*B65D 27/14* (2006.01)
*B42D 15/08* (2006.01)

(52) U.S. Cl.
CPC ..... *B65D 27/14* (2013.01); *B42D 15/08* (2013.01)

(58) Field of Classification Search
CPC ..... B65D 27/14; B65D 27/06; B42D 15/08; B42D 15/0053
USPC ..... 229/92.1, 305, 70, 300, 301, 75, 68.1; 283/116
See application file for complete search history.

(56) References Cited

U.S. PATENT DOCUMENTS 2,963,806 A * 12/1960 King ..... G09F 1/00 40/445
4,589,590 A * 5/1986 McGuire ..... B42D 5/02 156/291
7,726,550 B2 * 6/2010 Wilen ..... B42D 5/026 229/301
2010/0193581 A1 * 8/2010 Dyer ..... B42D 15/08 229/305

* cited by examiner

*Primary Examiner* — Christopher R Demeree
(74) *Attorney, Agent, or Firm* — Keith A. Vogt; Keith Vogt, Ltd.

(57) ABSTRACT

The present invention solves the disadvantages of the prior art. One embodiment of the present invention provides a new and improved envelope assembly that saves at least one piece of paper per mail and could potentially saves millions of pieces of paper over time. The present invention, in one of its embodiments also provides a new and improved envelope assembly which enables the user to quickly access terms and conditions of a promotional invitation which are often important or required by law. The parts of the envelope assembly can be relatively inexpensive to manufacture and mass produce, and easy to assemble. The envelope assembly is useful as a conventional envelope for letters, invitations or the like, or as a mailer for commercial invites for applications.

8 Claims, 8 Drawing Sheets

SAVE ON INTEREST WITH A LOW INTRO APR.

You've been pre-selected to apply.

information

0% Intro APR for 21 months on purchases from date of account opening and on balance transfers from date of first transfer 14.99%* variable APR after that All balance transfers must be completes within the first 4 months of account opening. There is a 3% balance transfer fee (minimum $5) for each transfer 999 9999 9999 9999

We're always looking to bring you great opportunities. And today is no exception. You've been pre-selected to apply for one of our great cards — the Citi® Diamond Preferred® Card. It offers a low intro APR for 21 months, $0 liability on unauthorized charges and much, much more.

702

SAVINGS THAT ADD UP

- Enjoy 0% Intro APR for 21 months on purchases and balance transfers — it's one of our longest-lasting offers.*
- There's no annual fee.*
  *Please see the enclosed Citi Disclosures for rates, fees and other cost information.
- Citi® Price Rewind does an online search for 60 days for lower prices on your registered purchases. You can get back up to $500 per item and $2,500 per year. See back of letter for more details.†

PROTECTION THAT'S THERE WHEN YOU NEED IT

- Get year-round coverage with $0 liability on unauthorized charges and 24/7 Fraud Early Warning.
- EMV Chip Technology provides you with global acceptance and enhanced security at chip-enabled terminals.
- Get free access to your FICO® Score, so you can stay up-to-date on your credit history.

APPLY TODAY FOR THE CARD YOU CAN COUNT ON.

Respond before 00/00/2018 and use your Invitation Number: 999999999999

704

☒ Fast response: citi.com/applydiamondpreferred ☒ 1-800-657-3371 TTY Use Relay Service ☒ Mail the pre-selected form You can choose to stop receiving "prescreened" oers of credit from this and other companies by calling toll-free 1-888-5-OPTOUT (1-888-567-8688). See PRESCREEN & OPT-OUT NOTICE on the other side for more information about prescreened offers.

T-1217-257P132AA W4 999999999999 99999 09 99 A-1217-257P132

FIG. 7

700

Diamond Preferred Card Terms and Conditions of Offer

This offer is valid for new accounts only. You must be at least 18 years of age. If you're married, you may apply for a separate account. N.A., Sioux Falls, SD, ("we"or"us") is the issuer of your account. Please allow 4 weeks from date of submission to process your Card Account application.

By submitting this application, toy request that Citi establish a Citi Diamond Preferred Card account (the "Card Account") to you and any authorized users you have designated. You agree that all information provided in the application must be verifiable and accurate. The Card Account is governed by the terms of the card agreement ("Card Agreement") provided when the Card Account is issued.

IDENTITY VERIFICATION

IMPORTANT INFORMATION ABOUT PROCEDURES FOR OPENING A NEW ACCOUNT - To help the government fight the funding of terrorism and money laundering activities, federal law requires all financial institutions to obtain, verify, and record information that identifies each person who opens an account. This means that we will ask for your name, address, date of birth, and other information that will allow us to identify you when you open an account. We may also ask to see your driver's license of other identifying documents; and obtain identification information about you or any authorized user you add to your account.

CREDIT REPORTS

You authorize us to get credit reports and other information about you from consumer reporting agencies and other sources, for such purposes as: determining whether to issue you a Card Account, administering, reviewing and renewing the Card Account, credit line increases or decreases, collection and other servicing of the Card Account, and offering other products and services and for any other uses permitted by law. If you ask us, we'll tell you whether or not we requested a credit bureau report and the names and addresses of any credit bureaus that provided us with such reports. From time to time, we may report negative information about your Card Account behavior, like delinquencies, to consumer reporting agencies.

CREDIT INFORMATION

To receive a Card Account, you must meet our applicable criteria bearing on creditworthiness.

Your credit limit will be determined based on the following:
- Your annual salary and wages
- Any other annual income
- A review of your debt, including the debt listed on your credit report We'll inform you of your credit limit when you receive your credit card. Some limits may be as low as $500. Please note that cash advances may be limited to a portion of your credit limit.

To process the Application Form for a new account, it must be:
- Accurately completed
- Signed and verifiably correct
- Returned by the expiration date Please send the nontransferable Application Form in the enclosed postage-paid envelope to:
- Citibank New Cardmember Services
- P.O. Box 6168, Sioux Falls, South Dakota 57117-9720

CARD AGREEMENT

If you are approved for a Card Account, you'll receive a Card Agreement before you can use your Card Account. The terms of the Card Agreement will take effect once you use your Card Account. Even if you do not use your Card Account, the Card Agreement will take effect if you do not cancel your Card Account within 30 days after we send you the Card Agreement.

We have the right to make changes to the terms of your Card Account (including rates and fees) in accordance with the Card Agreement.

SPECIAL NOTICES

Notice to Ohio Residents: The Ohio laws against discrimination require that all creditors make credit equally available to all creditworthy customers, and that credit reporting agencies maintain separate credit histories on each individual upon request. The Ohio Civil Rights Commission administers compliance with this law.

Notice to Wisconsin Residents: No marital property agreement, unilateral statement, or court decree adversely affects our rights, unless you give us a copy of such agreement, statement or court order before we grant you credit, or we have actual knowledge of its terms before your account is opened.

††IMPORTANT INFORMATION ABOUT ADDING AN AUTHORIZED USER

Before adding an authorized user to your Card Account you should know:
- You're responsible for all charges made or allowed to the Card Account by the authorized
- user
- Authorized users have access to your Card Account information
- Before adding an authorized user, you must let him/her know that we may report Card
- Account performance to the credit reporting agencies in the authorized user's name If we ask for information about the authorized user, you must obtain their permission to share their information with us and for us to share it as allowed by applicable law.

BALANCE TRANSFER INFORMATION

How to Make Balance Transfers

1. After receiving your card, you can call the customer service number on the back of your After receiving your card, you can call the customer service number on the back of your card to transfer balances. Balance transfers are made available at our discretion. All balance transfers are subject to the standard purchase APR unless an introductory and/or other promotional rate applies.
2. if we give you the option to transfer a balance with your application, it will take at least 14 days after your Card Account is opened to process any balance transfer payments. During this time, you may cancel or modify your balance transfer request by calling the number on the back of your card.
3. You may transfer any amount, but the total amount of your balance transfer plus balance transfer fees must be less than your available credit limit. Be sure you don't transfer any disputed purchase or other charge amount because you may lose your dispute rights. You can't transfer balances from other accounts issued by Citibank, N.A. or it's affiliates. To see if your Card Account is issued by Citi, go to citi.com/affiliatesproducts for a list of Citi products and affiliates.
4. Continue to make payments on your other accounts untill you have confirmed this balance transfer has been received. Once approved, we'll pay the amount of the balance transfer directly to that issuer. The available credit limit for your new card will be reduced by the total amount of the transfers, including fees we approve.

Things You Should Know About Your Balance Transfer Offer

If you transfer a balance with this offer, interest will be charged on purchases made with your Card Account unless your purchases have a 0% APR, or you pay the New Balance shown on your statement (including the amount of your balance transfer) in full by the payment due date each billing period.

If you default under your Card Agreement you may lose any promotional APR on the balance transfer.

ADDITIONAL INFORMATION

Any benefit, reward, service or feature offered in connection with your Card Account may change or be discontinued at any time for any reason, except as otherwise expressly indicated. Citi isn't responsible for products and services offered by other companies.

PRESCREEN & OPT_OUT NOTICE: This "prescreened" offer of credit is based on information in your credit report indicating that you meet certain criteria. This offer is not guaranteed if you do not meet our criteria. If you do not want to receive prescreened offers of credit from this and other companies, call the consumer reporting agencies toll-free at 1-888-5-OPTOUT (1-88-567-8688) or write to any of the following consumer reporting agencies.

Experian Information Solutions, P.O. Box 919, Allen, TX 75103;
Equifax Options, P.O. Box 740123, Atlanta, GA 30374-0123;
TransUnion, P.O. Box 505, Woodlyn, PA 19094-0505.

HERE'S HOW YOU CAN SAVE EVEN AFTER YOU BUY.

702

704

FIG. 8

700

LETTER ENVELOPE

RELATED APPLICATIONS

This application claims priority to U.S. Provisional Patent Application Ser. No. 62/718,316, filed Aug. 13, 2018, titled the same and incorporated herein as if set out in full.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

FIELD OF THE INVENTION

The present description relates generally to an envelope assembly having a printed message printed directly on the inside of a mailing envelope on printing space that otherwise is unused for printing information in connection with direct mail marketing. In one embodiment of the present invention, the envelope assembly contains a returning envelope, and additional information pages accompanying the information printed on the inside of the mailing envelope enclosing the returning envelope.

BACKGROUND

The present invention is related to a particular means for printing on the inside of an envelope thus providing convenient access to either an important or legally required consumer message. More particularly, the present invention is related to such an envelope that can be assembled into an information kit, that contains a returning envelope, additional information pages transmitted in the envelope with important or required information printed on the inside of the mailing envelope, that would otherwise require additional printed material to be placed in the envelope at a material extra cost for the party who is sending out these types of mailings.

Envelopes of unitary construction for mailing letters, invitations, and the like using part of the envelope surface for the name and address of the recipient are well known. However, these envelopes generally have a number of disadvantages. First, the envelopes generally tend to have a very plain appearance. In most cases, the envelope is monochromatic and has a blank surface on the inside of the envelope. The flap used to close the envelope also is very plain and ordinary, both on the outside and on the inside.

Such conventional envelopes are not ideally suited for mailing promotional invitations. When promotional invitation is simply included in a conventional envelope along with other details, for example, important information regarding the promotional offer may become separated from the envelope and misplaced once the envelope is opened by the recipient. Moreover, certain messages that are required to be provided, require additional printed material to be placed in the envelope, materially increasing the cost of such direct mailings because more paper is used and additional weight adds to postal costs. Specialty promotional offer mailers are thus needed to save cost, reduce the amount of paper consumed and more effectively promote the offer, to encourage users to apply for the offer and/or receive important and/or legally required information. Ideally, such an envelope would be relatively inexpensive to manufacture. It also would be multi-functional and would be particularly well-suited for use with promotional invitations both as an envelope designed for protecting an application and a returning envelope during passage through the mail, and also as a convenient information sheet once the recipient has opened the envelope.

The present invention fulfills these and other needs.

SUMMARY OF THE INVENTION

The present invention solves the disadvantages of the prior art. An object of the invention is to provide a new and improved envelope assembly that saves at least one piece of paper per mail and could potentially saves millions of pieces of paper over time. It also provides a new and improved envelope assembly which enables the user to quickly access terms and conditions of a promotional invitation which are often important or required by law. The parts of the envelope can be relatively inexpensive to manufacture and mass produce, and easy to assemble. The envelope assembly is useful as a conventional envelope for letters, invitations or the like, or as a mailer for commercial invites for applications.

The envelope assembly in other aspects includes at least one first sheet, one second sheet and one third sheet, both the first sheet and the third sheet are printed on both sides. The second sheet is printed on only one side. The first sheet and the second sheet both have a central portion and two or more foldable portions on opposite sides of the central portion. The central portion of the first sheet and the second sheet is configured to adhere at least a part of the central portion of to each of the two foldable portions.

Other advantages, benefits, and features of the present invention will become apparent to those skilled in the art upon reading the detailed description of the invention and studying the drawings.

BRIEF DESCRIPTION OF THE DRAWINGS

A preferred embodiment of the present invention will now be described with reference to the figures accompanying the specification wherein:

FIG. 7 is a is a front view of a fourth sheet of the envelope assembly of the present invention.

FIG. 8 a is a rear view of a fourth sheet of the envelope assembly of the present invention.

DETAILED DESCRIPTION

Figure 1:
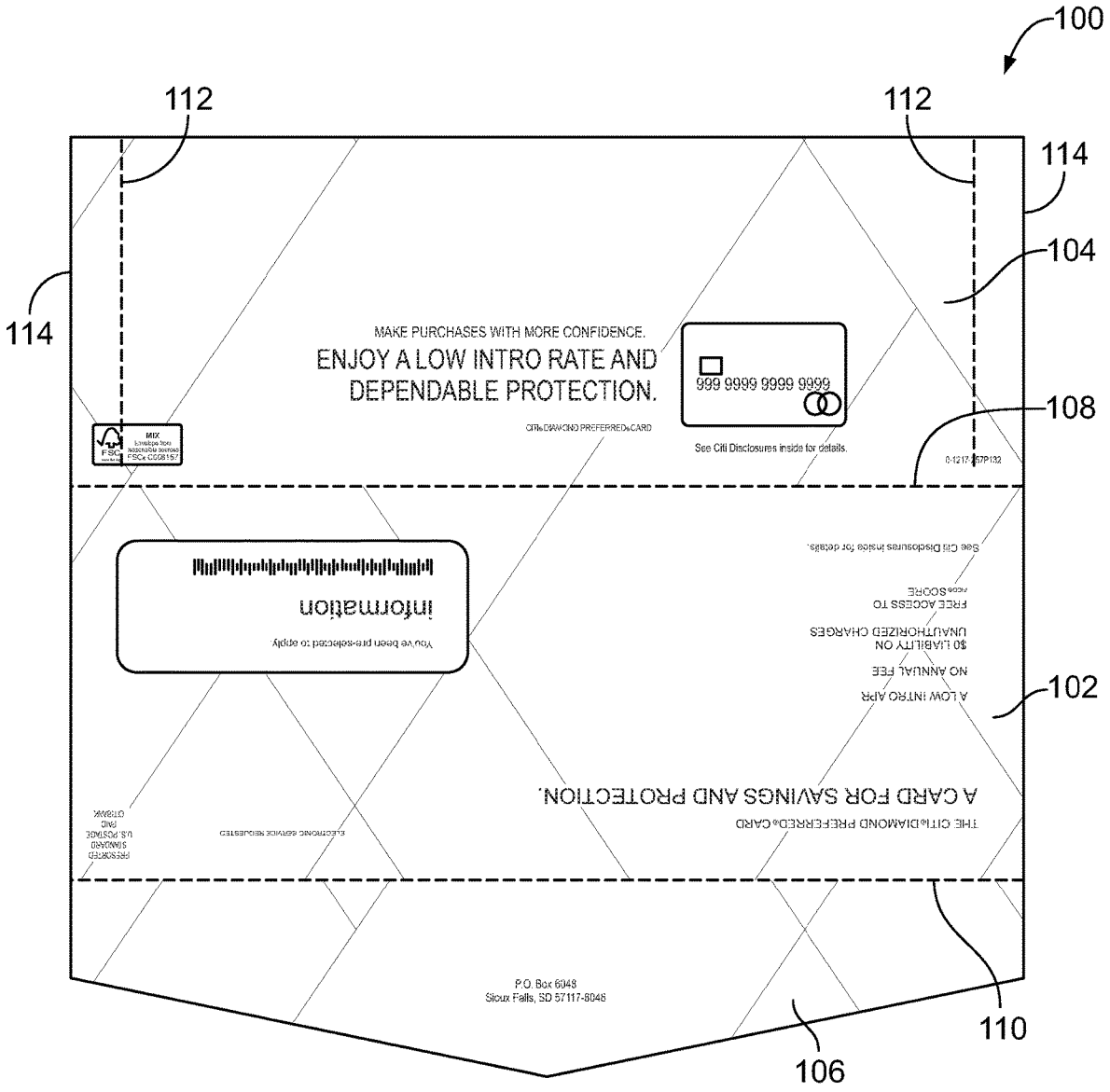
FIG. 1 is a front view of a first sheet of the envelope assembly of the present invention.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part. Accordingly, the invention is not to be restricted except in light of the attached claims and their equivalents.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below.

Figure 2:
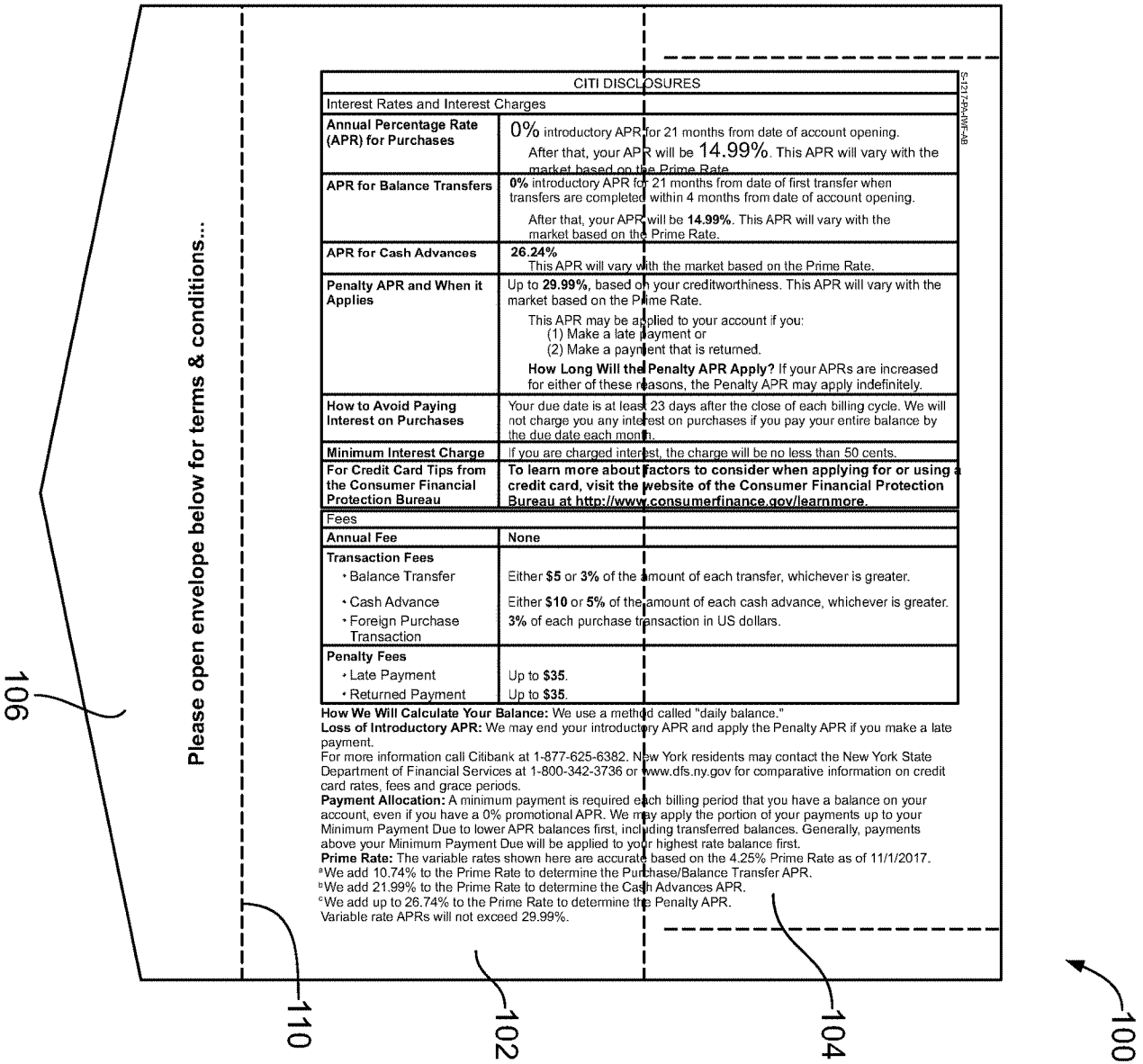
FIG. 2 is a rear view of a first sheet of the envelope assembly of the present invention.

Referring to FIGS. 1-2, the drawings provide for a first sheet of the mailing assembly of the present invention. The first sheet of the mailing assembly constitutes one embodiment of the mailing envelope 100 of the present invention. The first sheet has one central portion 102, which carries printed or written information, such as the name and/or name and address of the intended recipient of the envelope.

The central portion 102 is connected to two foldable portions 104 and 106 on opposite sides of the central portion 102. The two foldable portions 104 and 106 are folded along the folding lines 108 and 110. FIG. 1 illustrates the outside of the mailing envelope 100. Two foldable portions 104 and 106 fold inwardly along the folding lines 108 and 110 to form a closure. Adhesive material such as glue, is applied at the edges of foldable portion 104. In one embodiment of the present invention, the adhesive material is applied on the inside of the first sheet 100 (as will be illustrated in FIG. 2) between adhesive lines 112 and edges 114. When folded inwardly, foldable portion 104 and central portion 102 are then sealed together to form an envelope pocket.

FIG. 2 is the back view of the mailing envelope 100 illustrated in FIG. 1. As illustrated in this embodiment, the mailing envelope 100 is also printed on its inside. By printing information on the inside of the envelope 100, customers have easier access to the message from the sender of the mail. This embodiment of the present invention also prevented the separation of important message from the envelope, or the envelope assembly. Thus, the users won't misplace the important message or accidentally associate the message with a different sender, or a same sender from different occasions. In one embodiment, the envelope 100 may include a message on the outside indicating to the recipient that information can be found on the inside of the envelope. This reminder can also be printed on the inside of foldable flap 106, as seen in FIG. 2. When the foldable portion 104 is folded, and sealed with central portion 102, as illustrated in the description for FIG. 1 above, the printed message is enclosed in the envelope pocket. Foldable flap 106 can then be folded along folding line 110 to cover the opening created by central portion 102 and folded foldable portion 104. Glue can be applied to edges of foldable flap 106 to create a completely sealed envelope.

Figure 3:
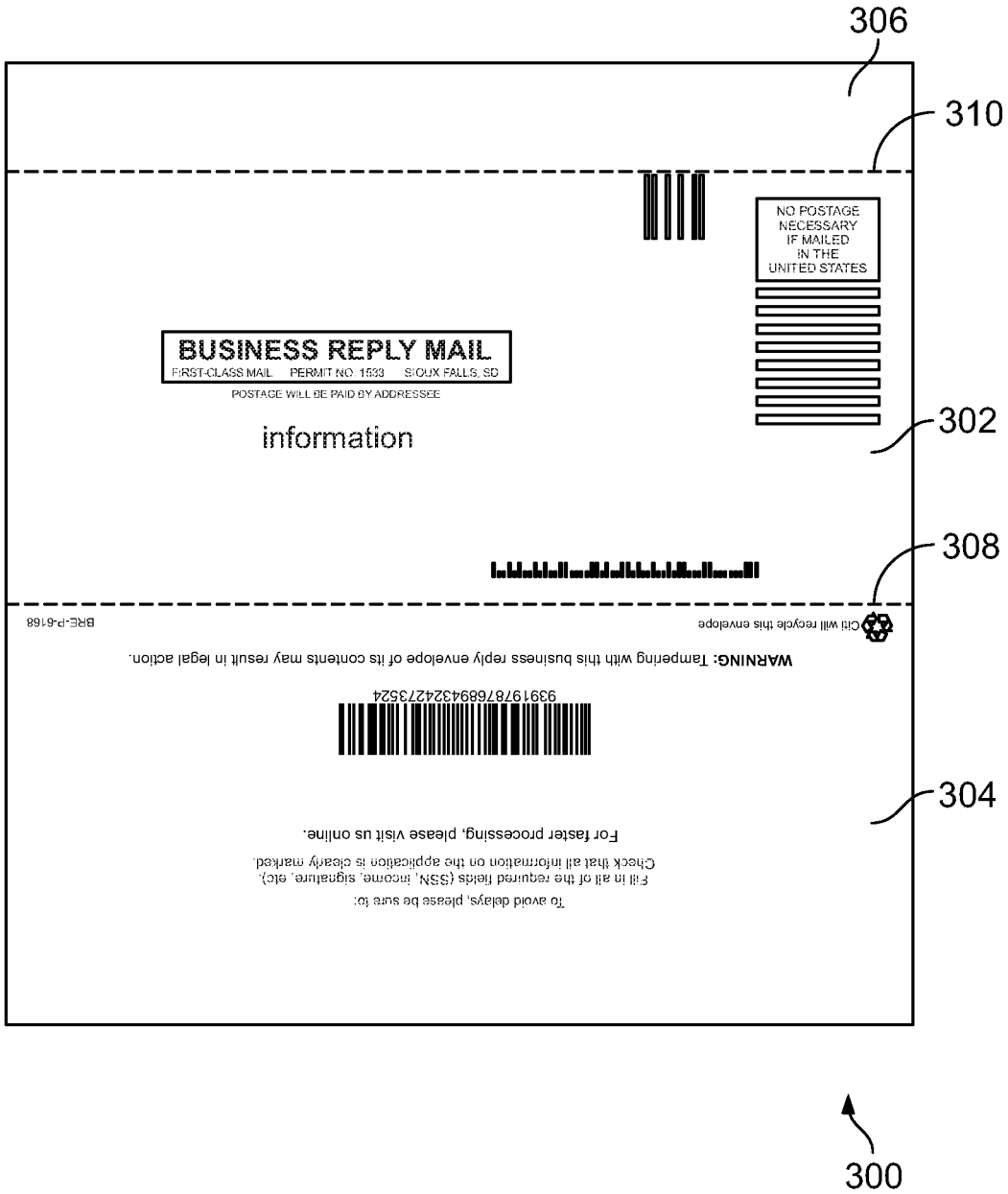
FIG. 3 is a front view of a second sheet of the envelope assembly of the present invention.
Figure 4:
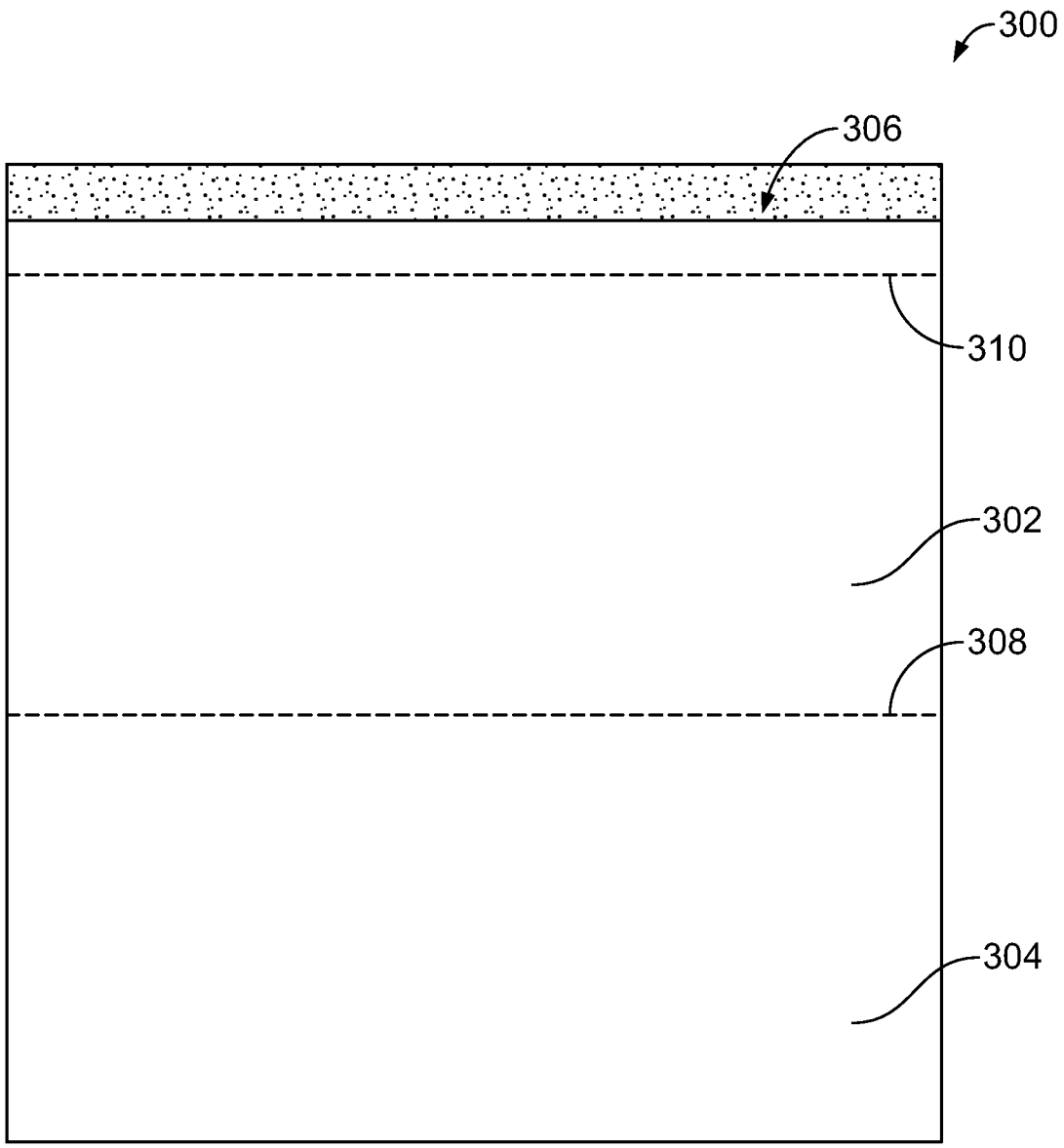
FIG. 4 is a rear view of a second sheet of the envelope assembly of the present invention.

A printed returning envelope can be included as a part of the mail assembly disclosed presently. FIGS. 3-4 illustrate another embodiment of the present invention and pertain to such returning envelope. For the users' convenience, the returning mailer may be separated from the mailing envelope disclosed in FIGS. 1-2. Similar to the mailing envelope disclosed in FIGS. 1-2, the returning envelope 300 also has one central portion 302 and two foldable portions 304 and 306. Foldable portion 304 folds along folding line 308 inwardly towards the inside of the returning envelope 300. Foldable flap 306 folds along folding line 310 inwardly towards the inside of the returning envelope 300.

The inside returning envelope 300 is illustrated in FIG. 4. Unlike the inside of the mailing envelope 100 illustrated in FIG. 2, the inside of the returning envelope is not printed but may be if desired. The edges of central portion 302 and foldable portion 304 are adhered together when foldable portion folds along folding line 308. A layer of moist glue can also be applied along the top edge of foldable flap 306. When folded along folding line 310, the opening created by central portion 302 and folded foldable portion 304 is covered.

Figure 5:
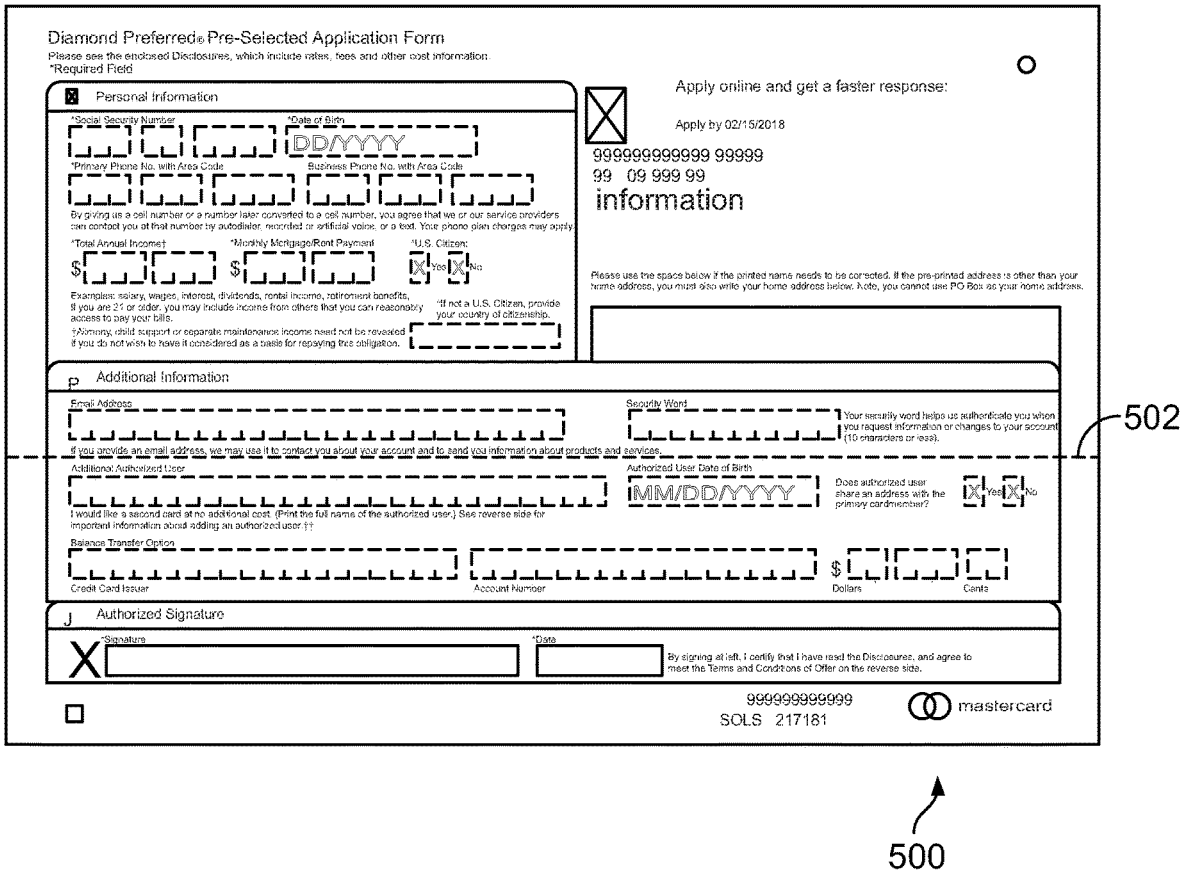
FIG. 5 is a is a front view of a third sheet of the envelope assembly of the present invention.
Figure 6:
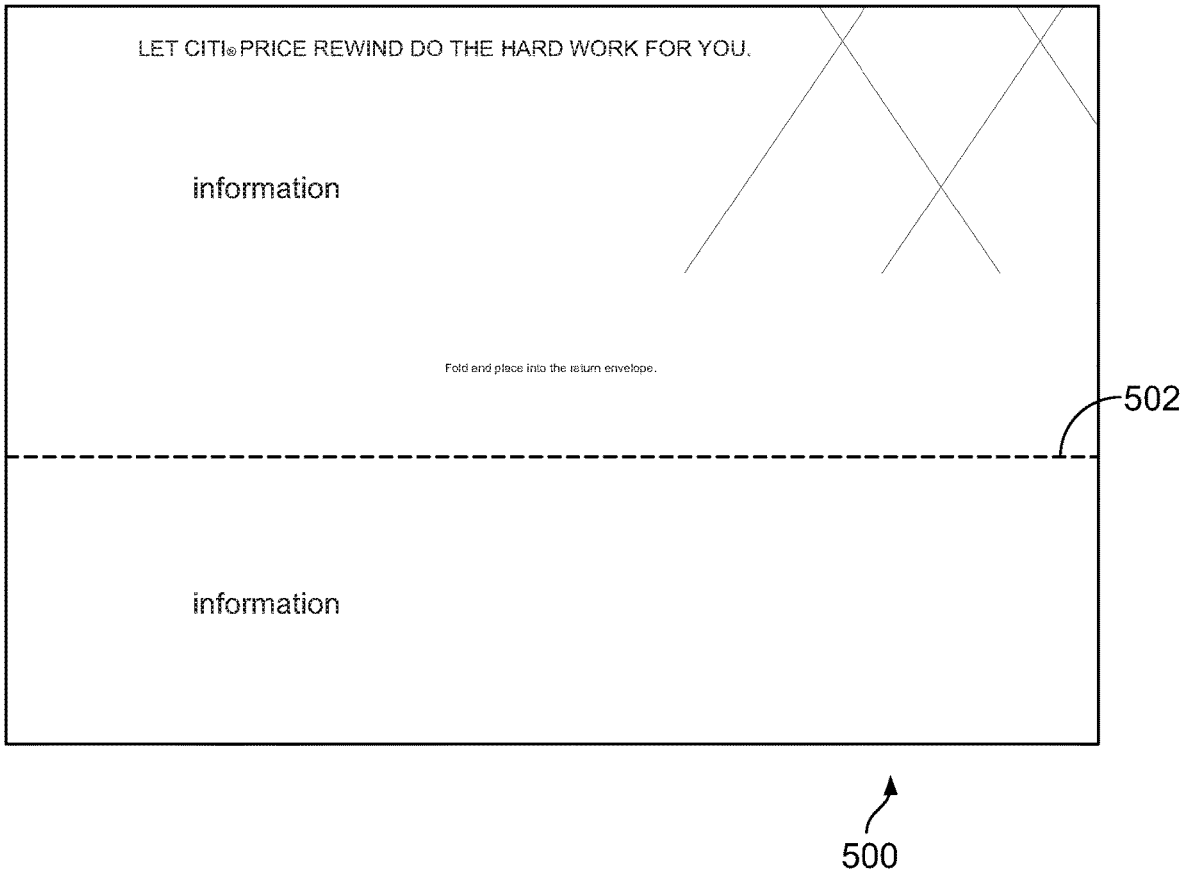
FIG. 6 is a rear view of a third sheet of the envelope assembly of the present invention.

FIGS. 5-6 illustrate the front and back of an application form 500 that may be a part of the present mailing assembly for yet another embodiment of the present invention. The front side of the application form 500 is presented in FIG. 5, and the back side of the application form 500 is presented in FIG. 6. The application form 500 intakes the recipient's personal information in order to complete an application for the promotional offer included in the mailing assembly of the present invention. The application form 500 is foldable along the folding line 502. The application form 500 could be folded either inwardly or outwardly by the user. The folded application form 500 is then suitable to be placed inside the returning envelope 300 illustrated in FIGS. 3-4 above.

FIGS. 7-8 are the front and back of a supplemental information page 700 accompanying the printed message on the back of the mailing envelope 100 illustrated in FIG. 2. In the illustrated embodiment both front side FIG. 7 and back side 8 of the page 700 are printed. The supplemental information page 700 can be folded along the folding lines 702 and 704. Folded supplemental information page 700 can be placed in the mailing envelope 100 described in FIGS. 1-2.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description. While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A mailing assembly comprising:

a. at least one first sheet, one second sheet, one third sheet, and one fourth sheet;

b. said first sheet is printed on both sides of the first sheet, said first sheet comprising:

i. one central portion;

ii. one foldable portion;

iii. one foldable flap; and iv. said foldable portion and foldable flap folded to form a mailing envelope to be sealed by adhesive material;

c. said second sheet comprising:

i. one central portion;

ii. one foldable portion;

iii. one foldable flap; and iv. said foldable portion and foldable flap folded to form a returning envelope to be sealed by adhesive material;

d. said third sheet is printed on at least one side of said third sheet, said third sheet is foldable to be inserted into said returning envelope; and e. said fourth sheet printed on at least one side of said fourth sheet, said fourth sheet is foldable to be inserted into said mailing envelope.

2. A mailing assembly of claim 1, wherein said second sheet is printed on at least one side of the second sheet.

3. A mailing assembly of claim 1, said third sheet is printed on at least one side of the third sheet.

4. A mailing assembly of claim 1, said third sheet is printed on at least one side of the third sheet.

5. A mailing assembly of claim 1, wherein the first sheet comprises name and address information on one side, information regarding an offer or terms on a second side.

6. A mailing assembly of claim 1, wherein the first sheet comprises name and address information on one side, information regarding an offer or terms on a second side.

7. A mailing assembly of claim 1, wherein the first sheet comprises name and address information on one side, information regarding an offer or terms on a second side.

8. A mailing assembly of claim 1, wherein the first sheet comprises name and address information on one side, information regarding an offer or terms on a second side.

* * * * *